US010845158B2

(12) United States Patent
Mezynski et al.

(10) Patent No.: US 10,845,158 B2
(45) Date of Patent: Nov. 24, 2020

(54) FIREARM HANDGUARD ADAPTER ASSEMBLY

(71) Applicant: AIRTRONIC USA, LLC, Spring Branch, TX (US)

(72) Inventors: Ryan Mezynski, Spring Branch, TX (US); Kiefer Schellhase, College Station, TX (US)

(73) Assignee: AIRTRONIC USA, LLC, Spring Branch, TX (US)

( * ) Notice: Subject to any disclaimer, the term of this patent is extended or adjusted under 35 U.S.C. 154(b) by 0 days.

(21) Appl. No.: 16/200,480

(22) Filed: Nov. 26, 2018

(65) Prior Publication Data

US 2019/0162505 A1 May 30, 2019

Related U.S. Application Data

(60) Provisional application No. 62/591,051, filed on Nov. 27, 2017.

(51) Int. Cl.

| | |
|---|---|
| ***F41C 27/00*** | (2006.01) |
| ***F41C 23/16*** | (2006.01) |
| *F41C 27/06* | (2006.01) |
| *F41G 11/00* | (2006.01) |

(52) U.S. Cl.

CPC ..... *F41C 27/00* (2013.01); *F41C 23/16* (2013.01); *F41C 27/06* (2013.01); *F41G 11/003* (2013.01)

(58) Field of Classification Search

CPC ..... F41C 27/00; F41C 27/06

See application file for complete search history.

(56) References Cited

U.S. PATENT DOCUMENTS

| | | | | |
|---|---|---|---|---|
| 8,739,448 | B2 * | 6/2014 | Kimmel | F41C 23/16 42/124 |
| 8,863,426 | B1 * | 10/2014 | Zinsner | F41C 23/16 42/71.01 |
| 9,709,356 | B1 * | 7/2017 | Anstett | F41C 23/16 |
| 10,352,649 | B2 * | 7/2019 | Beaty | F41C 23/16 |
| 2013/0205636 | A1 * | 8/2013 | Shull | F41C 23/04 42/72 |
| 2017/0176135 | A1 * | 6/2017 | Fesas | F41C 23/16 |
| 2018/0306551 | A1 * | 10/2018 | Reid | F41C 23/16 |

FOREIGN PATENT DOCUMENTS

| | | | | |
|---|---|---|---|---|
| WO | WO-2017112608 | A1 * | 6/2017 | F41A 13/00 |

* cited by examiner

*Primary Examiner* — Stephen Johnson
(74) *Attorney, Agent, or Firm* — Polsinelli PC

(57) ABSTRACT

A handguard adapter assembly operable to couple a high recoil accessory to a firearm. The handguard adapter assembly comprises a mounting system operable to be coupled to the firearm. The mounting system can be configured to be disposed around a substantially tubular member and can comprise a lower clamp and an upper clamp operably engaged with the lower clamp. The handguard adapter assembly can also comprise a lower handguard operably coupled to the lower clamp and an upper handguard operably coupled to the lower handguard.

13 Claims, 9 Drawing Sheets

FIREARM HANDGUARD ADAPTER ASSEMBLY

CROSS REFERENCE TO RELATED APPLICATIONS

This application claims the benefit of U.S. Provisional Application No. 62/591,051, filed Nov. 27, 2017, the contents of which are incorporated by reference herein in their entirety.

FIELD

The present disclosure relates to a mounting device couplable to a firearm. More specifically, the present disclosure relates to a mounting device operable to couple one or more high recoil accessories to a firearm.

BACKGROUND

Grenade launchers have been typically designed as standalone units to handle the rigors of the firing of a grenade. Occasionally, grenade launchers are mounted to firearms via handguards. Conventional handguards provide picatinny rails and allow for the attachment of the grenade launcher to the firearm, but are not designed to withstand the forces exerted by the grenade launcher.

BRIEF DESCRIPTION OF THE DRAWINGS

The foregoing summary, as well as the following detailed description, will be better understood when read in conjunction with the appended drawings. For the purpose of illustration, there is shown in the drawings certain embodiments of the present disclosure. It should be understood, however, that the present inventive concept is not limited to the precise embodiments and features shown. The accompanying drawings, which are incorporated in and constitute a part of this specification, illustrate an implementation of apparatuses consistent with the present concept and, together with the description, serve to explain advantages and principles consistent with the present concept.

DETAILED DESCRIPTIONS

Figure 1:
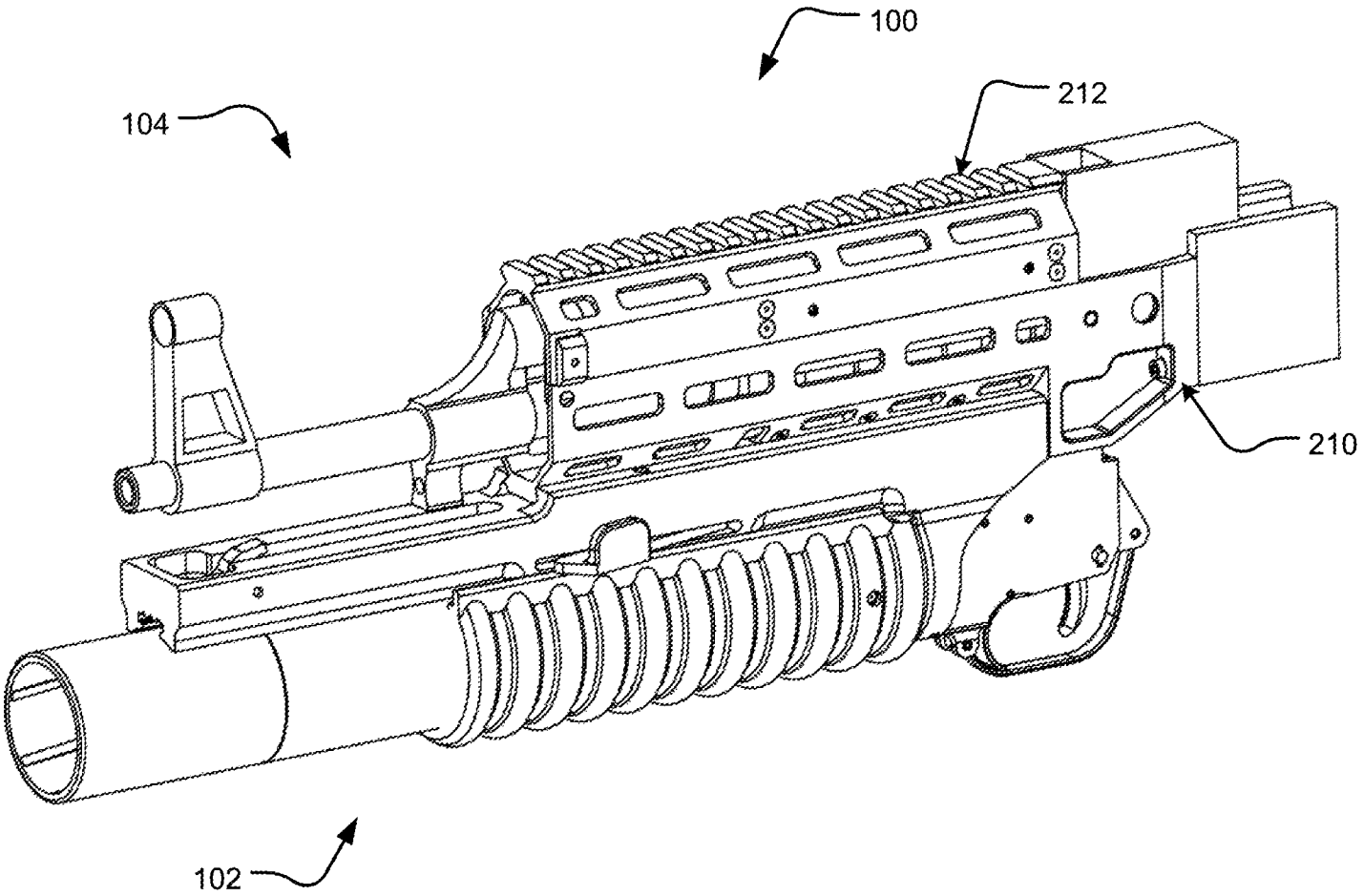
FIG. 1 is an assembly view of a handguard adapter assembly according to at least one instance of the present disclosure, the handguard adapter assembly couplable to a firearm using a mounting system.

The present disclosure provides a system and apparatus for coupling a high recoil accessory to a firearm. The aforementioned may be achieved in an aspect of the present disclosure by providing a handguard adapter assembly operable to couple a high recoil accessory to a firearm. The handguard adapter assembly can include a mounting system operable to be coupled to the firearm. The mounting system can include a lower clamp and an upper clamp. The upper clamp can be coupled with the lower clamp around at least a portion of a substantially tubular member. The mounting system can also include a lower handguard operably coupled to the lower clamp and/or an upper handguard operably coupled to the lower handguard.

The aforementioned may be achieved in another aspect of the present disclosure by providing a handguard adapter assembly. The handguard adapter assembly comprises a lower handguard operable to couple to a mounting system having a proximal end and a distal end opposite the proximal end. The lower handguard includes a trunnion mounting assembly on the proximal end, wherein the trunnion mounting assembly is receivable by an opening formed in a trunnion. The handguard adapter assembly further comprises an upper handguard operable to be coupled to the lower handguard, wherein the upper handguard is positioned over a substantially tubular member.

Several definitions that apply throughout this disclosure will now be presented. "Coupled" refers to the linking or connection of two objects. The coupling can be direct or indirect. An indirect coupling includes connecting two objects through one or more intermediary objects. Coupling can also refer to electrical or mechanical connections. Coupling can also include magnetic linking without physical contact. "Substantially" refers to an element essentially conforming to the particular dimension, shape or other word that substantially modifies, such that the component need not be exact. For example, substantially cylindrical means that the object resembles a cylinder, but can have one or more deviations from a true cylinder. The term "comprising"

means "including, but not necessarily limited to"; it specifically indicates open-ended inclusion or membership in a so-described combination, group, series and the like. "About" refers to almost, nearly, on the verge of, or without significant deviation from the numeric representation. For example, about 20 can be 20, or a small deviation from 20. The use of relational terms such as, but not limited to, "front," "rear," "underside," "upperside," "top," "bottom," "left," "right," "upper," "lower," "down," "downward," "up," "upward," and "side," are used in the description for clarity in specific reference to the figures and are not intended to limit the scope of the present inventive concept or the appended claims. "Lower" or "lower side" refer to a portion or surface relative to a firearm having a high recoil accessory extending from or coupling to the firearm. "Upper" and "upper side" refer to a portion or a surface opposite to the "lower" or "lower side." "Near" refers to a point or position located a short distance away. For example, near an end means that the point or position is located within a short distance from the end but is not at the end itself. "Portion" refers to a part of the whole, or less than the whole. For example, a portion of a circle means not the whole or entire circle, but a piece less than the whole circle.

A system and apparatus for coupling a high recoil accessory to a firearm is provided herein. In at least one implementation, a grenade launcher is operably coupled to a firearm via a handguard adapter assembly having a mounting assembly, a lower handguard, and an upper handguard. The mounting assembly allows the handguard adapter assembly to mount to a variety of different sized firearm barrels. The lower handguard and the upper handguard each have at least one picatinny rail formed thereon, by which they can each receive any high recoil accessory, such as a grenade launcher, or any other available firearm accessory. To reduce stress on the handguard adapter assembly created by recoil of the grenade launcher when fired, the lower handguard includes a trunnion mounting assembly receivable in an opening, or recess, formed in a trunnion of the firearm. The trunnion mounting assembly can be correspondingly shaped to be securely received within the opening of the trunnion. The handguard adapter assembly operably coupled to the trunnion via the trunnion mounting assembly can allow the stress created by the high recoil accessory mounted to the handguard adapter assembly to be transferred to the firearm, thereby reducing the stress experienced by the handguard adapter assembly.

FIG. 1 is an assembly view of a handguard adapter assembly 100 operable to couple a grenade launcher 102 to a firearm 104. The handguard adapter assembly 100 includes a lower handguard 210 and an upper handguard 212 coupled to the firearm 104 by a mounting system 200 (shown more clearly in FIG. 2). While a grenade launcher 102 is shown, the assembly 100 described herein can be configured to receive any number of firearm accessories such as, but not limited to, sights, bayonets, laser projection sights, knives, slings, lights, grips, infrared sights or sensors, bean bag launchers, and/or bipods.

The lower handguard 210 and the upper handguard 212 can each include at least one picatinny rail 218, 220, respectively, operable to couple with and/or receive one or more accessories to the firearm 104. In the illustrated example, the lower handguard 210 is shown with a grenade launcher 102 attached to the picatinny rail 218.

Figure 2:
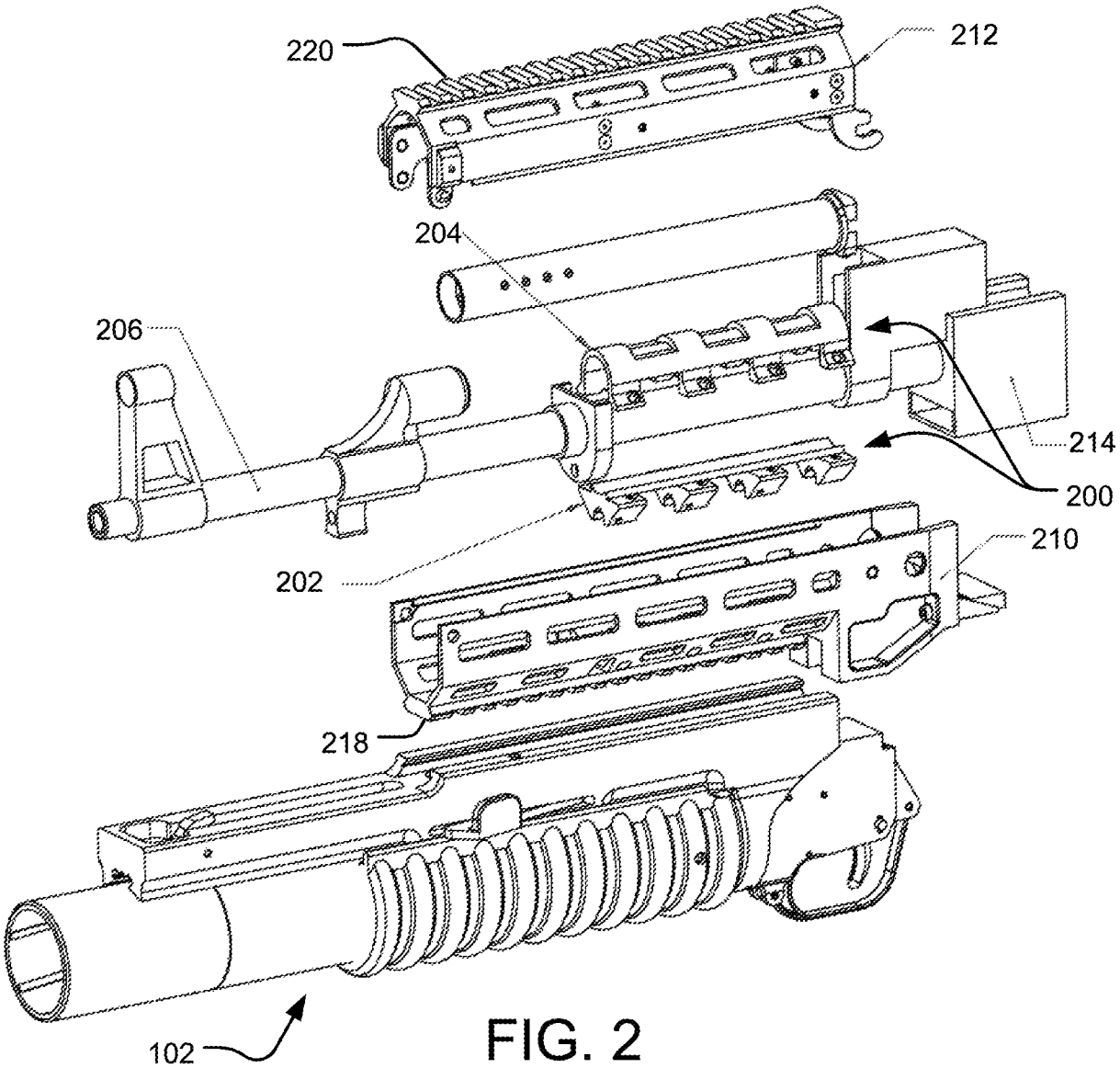
FIG. 2 is an exploded view of the handguard adapter assembly and mounting system of FIG. 1.

FIG. 2 is an exploded view of the firearm 102 and the handguard adapter assembly 100 of FIG. 1. The mounting system 200 can couple substantially over a tubular member 206. In one instance, the tubular member 206 may be a barrel of the firearm 104. While the tubular member 206 is shown and described as the barrel of the firearm 104, other implementations of the assembly 100 are within the scope of this disclosure. The mounting system 200 includes a lower clamp 202 and an upper clamp 204. The upper clamp 204 can couple with the lower clamp 202, thereby securing around at least a portion of a longitudinal length of the tubular member 206. The lower handguard 210 can operably couple to the lower clamp 202 and an upper handguard 212 can operably couple to the lower handguard 210. In one instance, a picatinny rail 220 of the upper handguard 212 can be operable to receive a sight. The sight can include, but is not limited to, a sight for the firearm 104 and/or a sight for the grenade launcher 102. In other examples, the picatinny rail 218 of the lower handguard 210 and picatinny rail 220 of the upper handguard 212 can be configured to receive any known picatinny accessory including, but not limited to, sights, bayonets, laser projection sights, knives, slings, lights, grips, bean bag launchers, bipods, or any combination thereof.

Figure 3A:
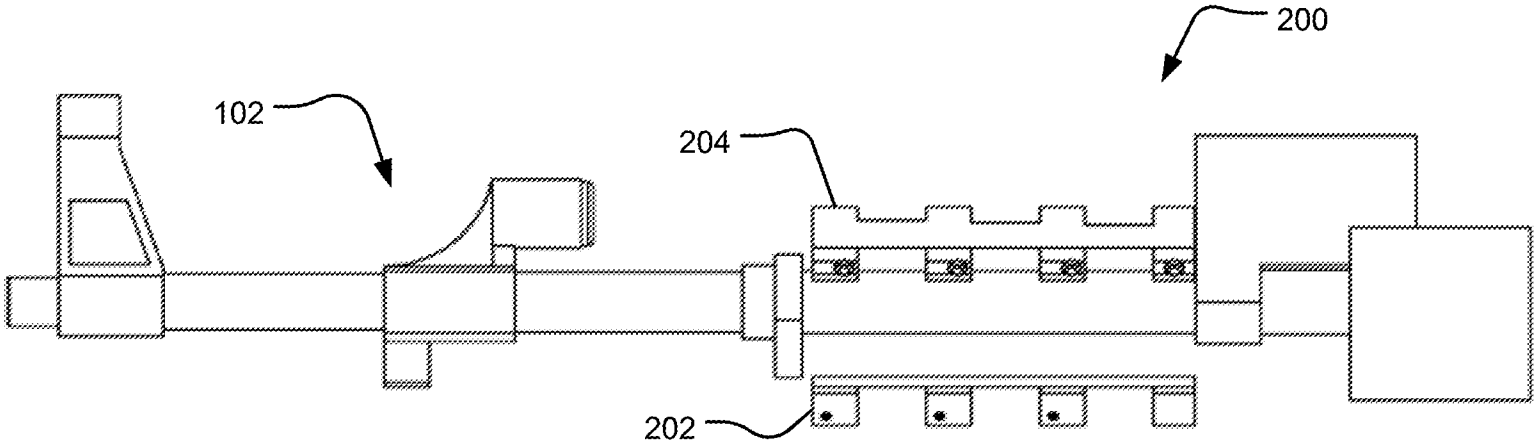
FIG. 3A is a side exploded view of a mounting system for coupling a handguard adapter assembly to a firearm according to at least one instance of the present disclosure.

FIG. 3A is a side exploded view of the mounting system 200 for coupling the assembly 100 to the firearm 104. During assembly, the lower clamp 202 can be positioned on a lower side of the tubular member 206 of the firearm 104 and the upper clamp 204 can be positioned on an upper side of the tubular member 206. While described in substantially over/under arrangement, it is within the scope of this disclosure to mount the upper/lower clamp at any angle on the barrel operable to properly engage the upper/lower handguard'

Figure 3B:
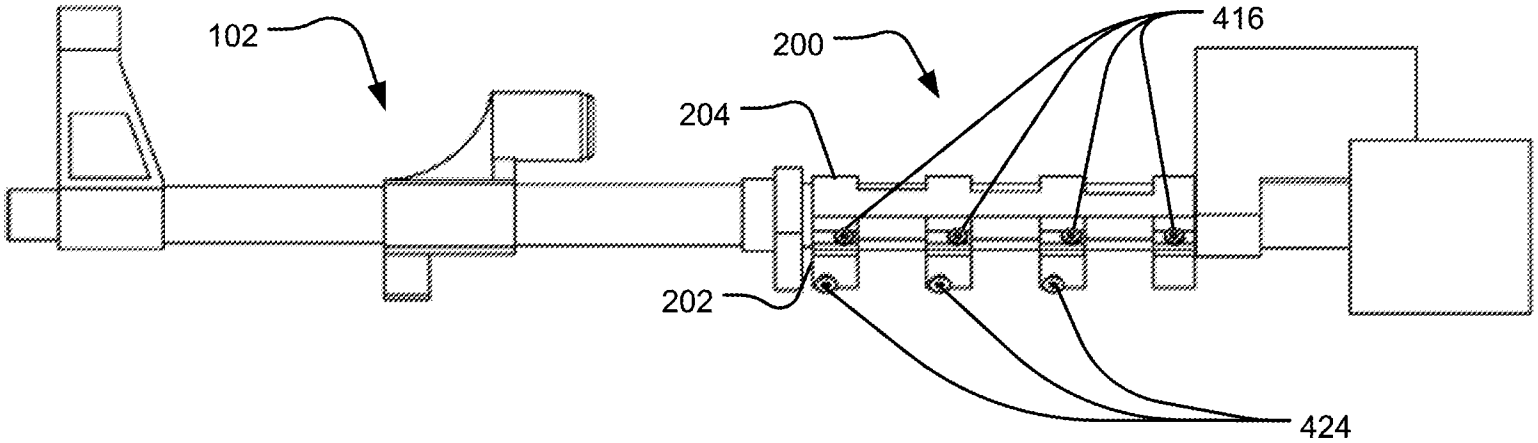
FIG. 3B is a side isometric view of a mounting system assembled on a firearm according to at least one instance of the present disclosure.

FIG. 3B is a side isometric view of the mounting system 200 assembled on the firearm 104. When the lower clamp 202 and the upper clamp 204 are substantially aligned on at least a portion of the barrel, the lower clamp 202 can be coupled to the upper clamp 204 by one or more fasteners 416. The coupling secures the upper clamp 204 and the lower clamp 202 to the tubular member 206, thus forming a compression fit over the tubular member 206 thereby preventing movement of the mounting system 200.

Figure 4:
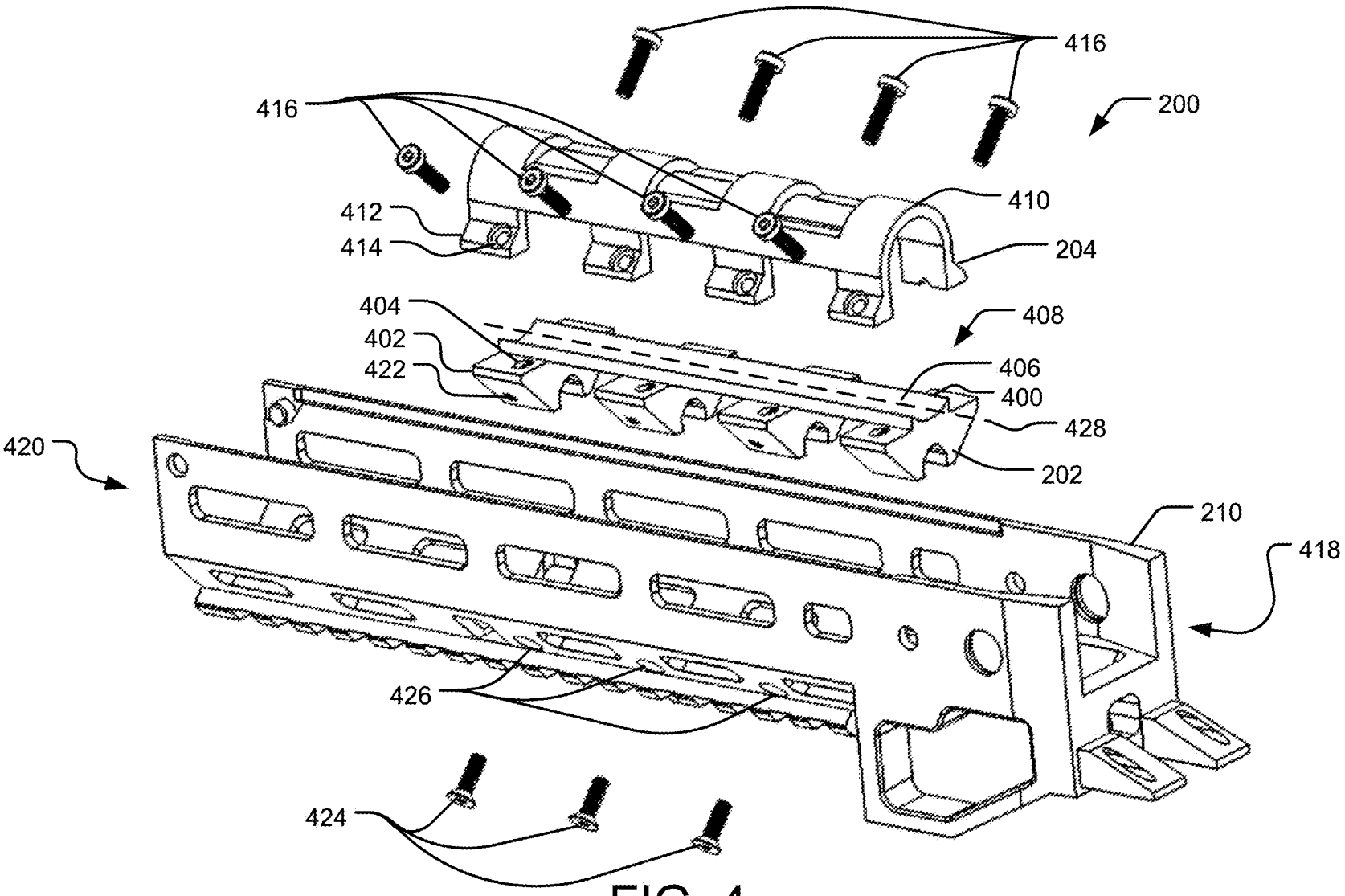
FIG. 4 is an isometric exploded view of a lower handguard of a handguard adapter assembly and a mounting system according to at least one instance of the present disclosure.

FIG. 4 is an isometric exploded view of the lower handguard 210 of the assembly 100 and the mounting system 200. The lower clamp 202 can include a concave surface 406 on at least one side 408 of a rail 400. The at least one side 408 of the rail can be operable to substantially engage the tubular member 206. The concave surface 406 can be operable to receive at least a portion of the tubular member 206. The upper clamp 204 can include a housing 410 that is disposable over and operable to receive at least a portion of the tubular member 206. In other instances, the upper clamp 204 can have a concave surface configured to abuttingly engage at least a portion of the tubular member 206 and the lower clamp 202 can have a housing disposable over and operable to receive at least a portion of the tubular member 206.

The lower clamp 202 can include a plurality of extensions 402 extending away from a longitudinal axis 428 of the rail 400. Each of the plurality of extensions 402 can include at least one upper clamp aperture 404. The upper clamp 204 can also include a plurality of clamp extensions 412 that correspondingly extend away from the longitudinal axis 428 of the rail 400. Each of the plurality of clamp extensions 412 can include at least one lower clamp aperture 414. The at least one lower clamp aperture 414 can be substantially aligned with the at least one upper clamp aperture 404 of each of the plurality of extensions 402 of the lower clamp 202 during installation and/or use. The upper clamp 204 is configured to be coupled with the lower clamp 202 by the fastener 416 secured between each of the lower clamp apertures 414 and the one upper clamp apertures 416. The fastener 416 can be fully threaded into the lower clamp 202 for a small diameter tubular member 206 and the fastener 416 can partially thread into the lower clamp 202 for a larger diameter tubular member 206. The fastener 416 provides for an adjustable fit, as the clamp member 200 can clamp over a variety of different sized tubular members 206. For instance, the fastener 416 can be partially fastened to receive a tubular member 206 of a larger diameter, and tightened on such tubular member 206. In the illustrated example, each of the at least one upper clamp apertures 404 are threaded to receive the correspondingly threaded fastener 416. In other examples, the upper clamp 204 can fasten to the lower clamp 202 by ratcheting, push-pins, rivets, or any other fastener arrangement.

In the illustrated instance, the lower clamp 202 has eight clamp extensions 402, each having the upper clamp aperture 404. Four clamp extensions 402 are located on one side of the rail 400 and the other four clamp extensions 402 are located on the other side of the rail 400. In the same example, the upper clamp 204 has eight clamp extensions 412 corresponding to and aligning with the upper clamp extensions 402 of the lower clamp 202, with each of the eight clamp extensions 412 (visible in FIG. 3B). Further to the example, eight fasteners 416 are secured between each of the lower clamp apertures 414 and each of the corresponding upper clamp apertures 404. While FIG. 4 is detailed with the lower clamp 202 and the upper clamp 204 each having eight clamp extensions 402, 412, it is within the scope of this disclosure to implement any number of clamp extensions 402, 412, for example, two, four, six, ten, or any other number.

Also shown in FIG. 4, the lower handguard 210 is configured to couple to the lower clamp 202. The lower handguard 210 has a proximal end 418 and a distal end 420 opposite the proximal end 418. Each of the plurality of extensions 402 of the lower clamp 202 further includes at least one lower handguard aperture 422. The lower handguard 210 includes at least one additional lower clamp aperture 426 aligned with the at least one lower handguard aperture 422 of each of the plurality of extensions 402. The lower handguard 210 is configured to be coupled with the lower clamp 202 by a fastener 424 secured between each of the lower handguard apertures 422 and the additional lower clamp apertures 426. In one example, each of the at least one lower handguard apertures 422 are threaded to receive the correspondingly threaded fastener 424. The fastener 424 can be threaded into the lower clamp 202. In other instances, the lower handguard 210 can fasten to the lower clamp 202 by ratcheting, push-pins, rivets, or any other fastener arrangement.

In the illustrated example, six of the eight clamp extensions 402 include the lower handguard aperture 422. The two clamp extensions 402 closest to the proximal end 418 of the lower handguard 210 can omit a lower handguard aperture 422. In the same instance, the upper handguard 210 has six additional lower clamp apertures 426 aligned with each of the lower handguard apertures 422. Further to the illustrated instance, six fasteners 424 are secured between each of the lower handguard apertures 422 and each of the corresponding additional lower clamp apertures 426. While FIG. 4 is detailed with the lower clamp 202 and the lower handguard 210 each having six apertures 422, 426, it is within the scope of this disclosure to implement any number of apertures 422, 426, for example, two, four, six, ten, or any other number.

Figure 5A:
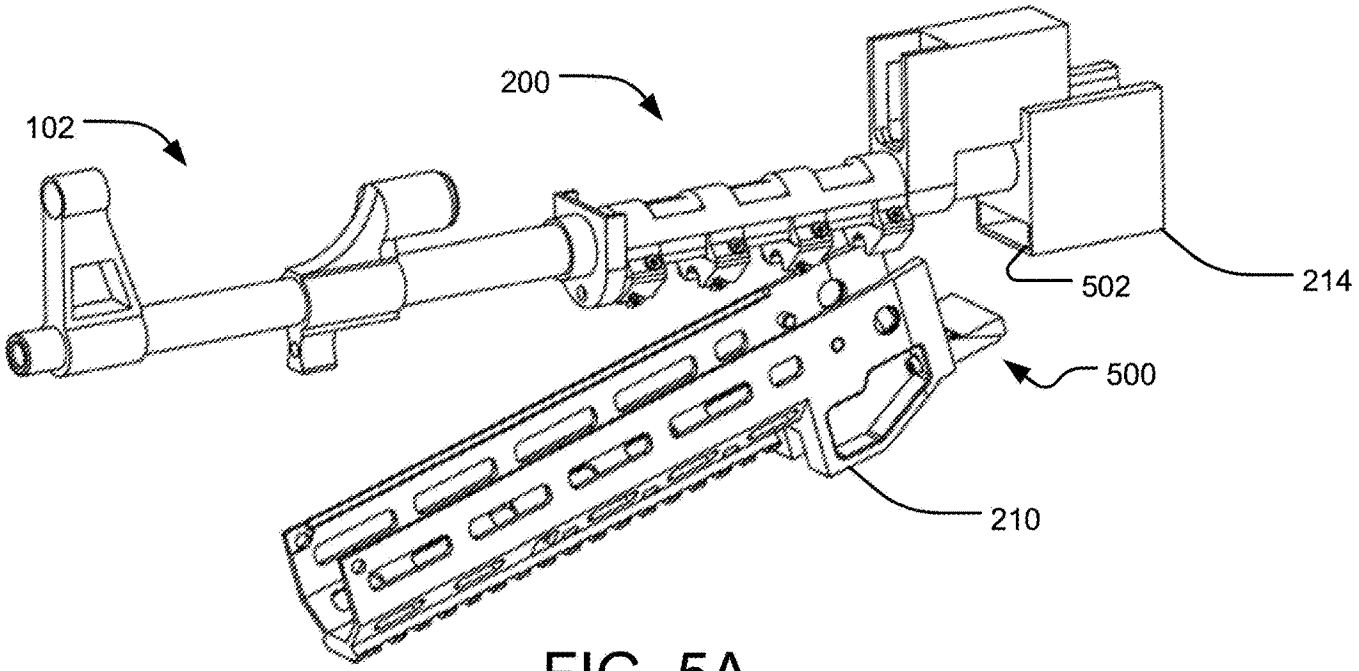
FIG. 5A is a side isometric view of a lower handguard in position for assembly onto a mounting system according to at least one instance of the present disclosure.

FIG. 5A is a side isometric view of the lower handguard 210 in position for assembly onto the mounting system 200. The lower handguard 210 is aligned such that a trunnion mounting assembly 500 of the lower handguard 210 can be received in an opening 502 formed in the trunnion 214.

Figure 5B:
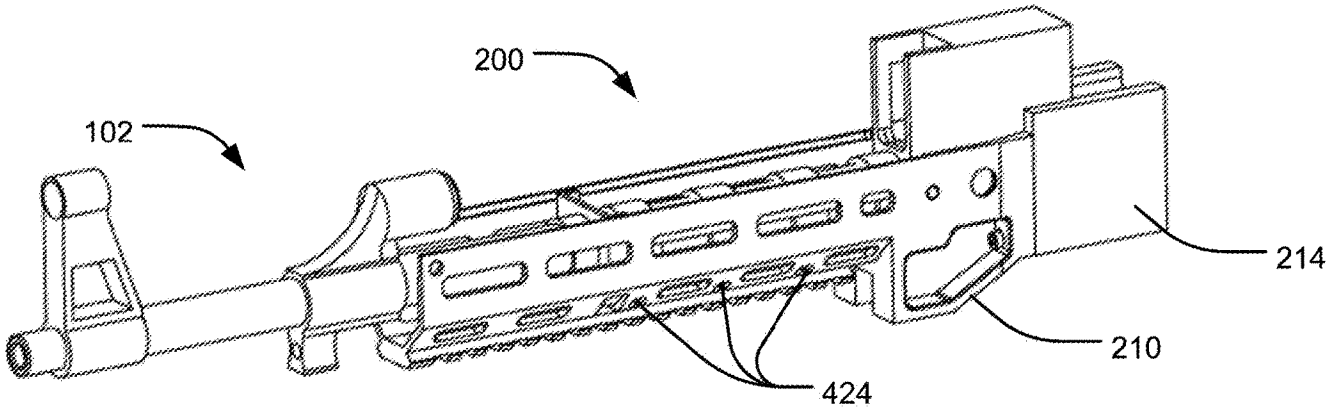
FIG. 5B is a side isometric view of a lower handguard assembled on a mounting system according to at least one instance of the present disclosure.

FIG. 5B is a side isometric view of the lower handguard 210 assembled on the mounting system 200. After the trunnion mounting assembly 500 is received into the opening 502, the trunnion mounting assembly 500 can be expanded within the opening 502, thereby securing the lower handguard to the trunnion 214. Further, each lower clamp aperture 426 is aligned with each lower handguard aperture 422 and receives one of the fasteners 424 to secure the lower handguard 210 to the lower clamp 202.

Figure 6B:
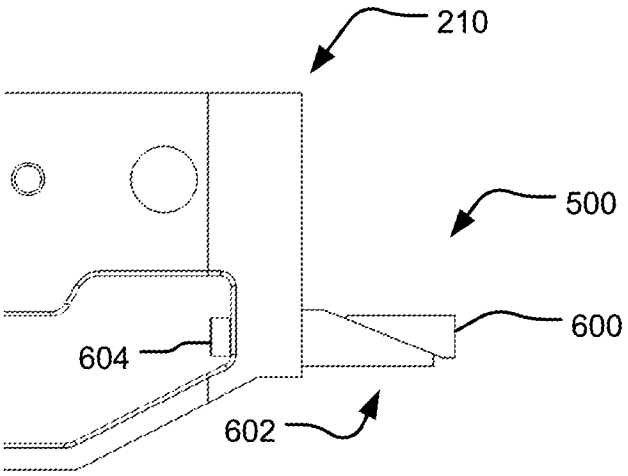
FIG. 6B is a side elevational view of a trunnion mounting assembly of a lower handguard according to at least one instance of the present disclosure.
Figure 6A:
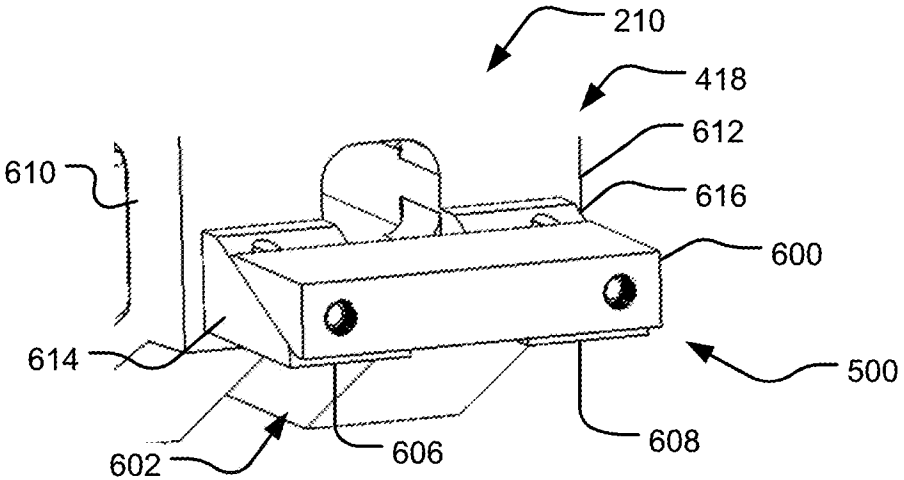
FIG. 6A is a rear isometric view of a trunnion mounting assembly of a lower handguard according to at least one instance of the present disclosure.

FIG. 6A is a rear isometric view of the trunnion mounting assembly 500 of the lower handguard 210 according to at least one instance of the present disclosure. The trunnion mounting assembly 500 includes an upper wedge 600 and a lower wedge 602 coupled by a fastener 604. The lower wedge 600 can be coupled to the lower handguard 210, for example, by a fastener or constructed into the lower handguard 210 such that the lower wedge 600 and the lower handguard 210 are a single piece. In one example, the lower wedge 602 includes a first wedge 606 positioned on a first side 610 of the proximal end 418 of the lower handguard 210 and a second wedge 608 positioned on a second side 612 of the proximal end 418 opposite the first side 610. The first wedge 606 and the second wedge 608 are spaced apart from each other. In the same example, the upper wedge 600 has a length spanning the distance between an outer surface 614 of the first wedge 606 and an outer surface 616 of the second wedge 608.

FIG. 6B is a side elevational view of the trunnion mounting assembly 500 of the lower handguard 210 according to at least one instance of the present disclosure. Each of the upper wedge 600 and the lower wedge 602 have an aperture formed therein. In the illustrated example, the upper wedge 600 has two apertures that each align with an aperture of each of the first wedge 606 and the second wedge 608. A fastener 604 is received by each of the two apertures. The upper wedge 600 is translatable relative to the lower wedge 602 by rotation of the fasteners 604. The upper wedge 600 translationally moves in a first direction (i.e., away from the second wedge 608) when the fasteners 604 are rotated in a first orientation (i.e., counter-clockwise) and translationally moves in a second direction (i.e., towards the second wedge 608) when the fasteners 604 are rotated in a second orientation (i.e., clockwise). Each fastener 604 can also be rotated and extended to different lengths to extend one side of the upper wedge 600 more or less than another side of the upper wedge 600.

Figure 6C:
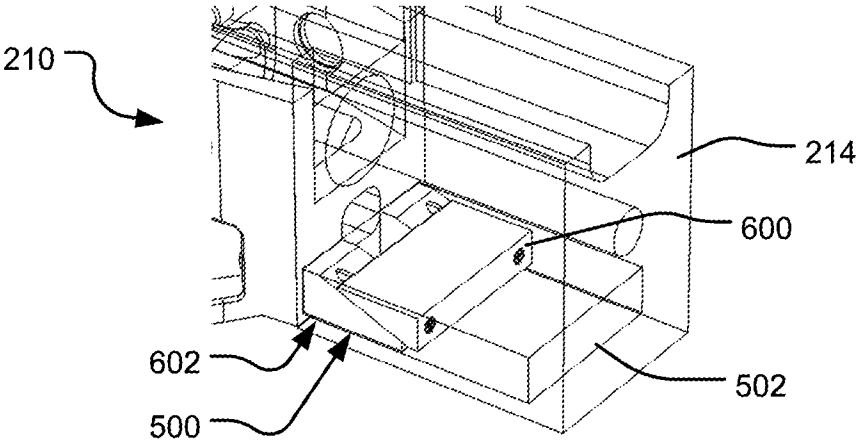
FIG. 6C is a rear isometric view of a trunnion mounting assembly of a lower handguard received in a trunnion according to at least one instance of the present disclosure, the trunnion shown transparent for clarity.

FIG. 6C is a rear isometric view of the trunnion mounting assembly 500 of the lower handguard 210 received in the opening 502, the trunnion 214 shown transparent for clarity. As shown, the trunnion mounting assembly 500 is received by the opening 502 of the trunnion 214, wherein the upper wedge 600 can be adjusted within the opening 502 by rotating the fastener 604, resulting in the upper wedge 600 either extending translatably further into the opening 222 or retracting towards the lower wedge 602. The trunnion mounting assembly 500 prevents damage to the handguard assembly 100 by redirecting a majority of the recoil force from the handguard assembly 100 into the firearm 104, thus preventing major damage to the handguard assembly 100. More specifically, the trunnion mounting assembly 500, which is attached to the lower handguard 210, contacts the trunnion 214, which is attached to the barrel 206 of the firearm 104. The contact provides for an outlet for a recoil force of the grenade launcher to transfer from the lower handguard 210, to the barrel 206, thereby preventing the lower handguard 210 from receiving the entirety of the recoil force.

Figure 7A:
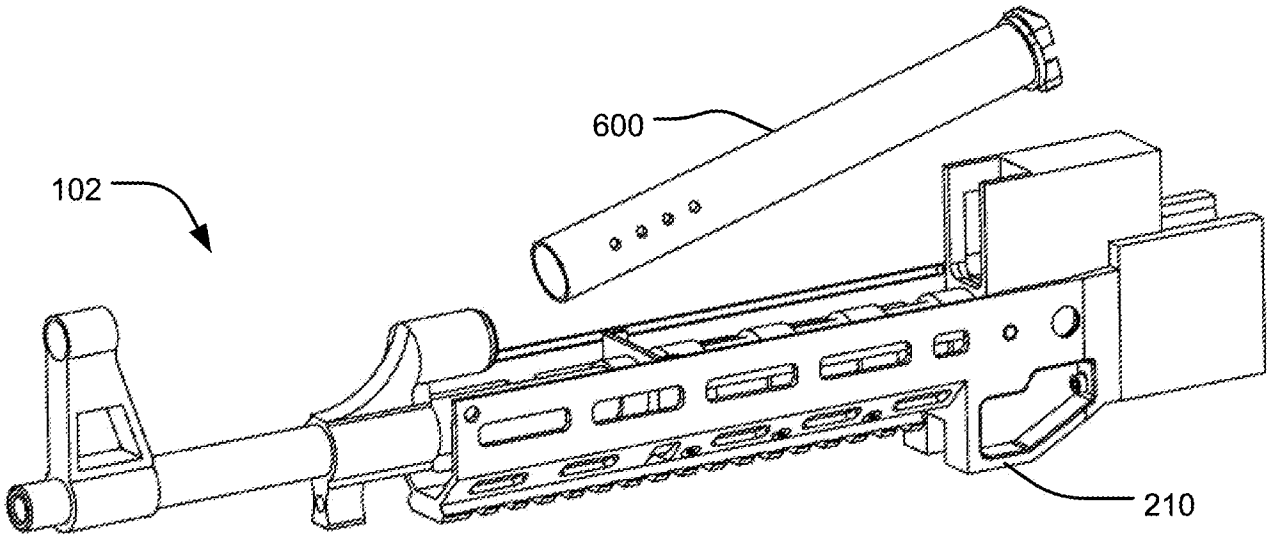
FIG. 7A is an isometric view of a gas piston assembly in position for mounting onto a firearm having a mounting system and lower handguard received thereon according to at least one instance of the present disclosure.

FIG. 7A is an isometric view of a gas piston assembly 600 in position for mounting onto the firearm 104 having the mounting system 200 and lower handguard 210 received thereon. The gas piston assembly 214 is assembled above the barrel of the firearm 104 and the mounting system 200.

Figure 7B:
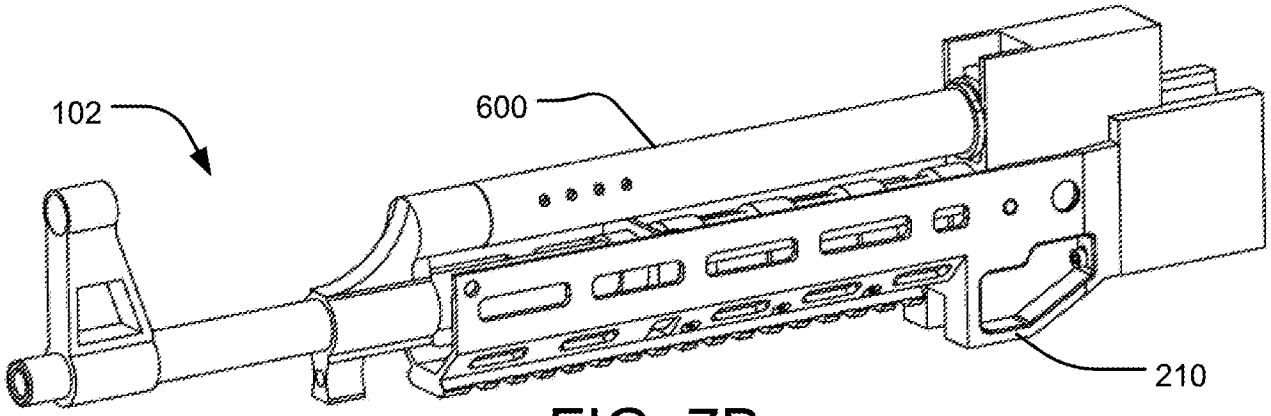
FIG. 7B is an isometric view of a gas piston assembled onto a firearm having a mounting system and lower handguard received thereon according to at least one instance of the present disclosure.

FIG. 7B is an isometric view of the gas piston assembly 600 assembled onto the firearm 104 having the mounting system 200 and lower handguard 210 received thereon. The gas piston assembly 600 remains easily accessible for cleaning and maintenance after the assembly 100 is fully installed as the upper handguard 212 can be removed from the lower handguard 210 without the need to remove the entire assembly 100.

Figure 8A:
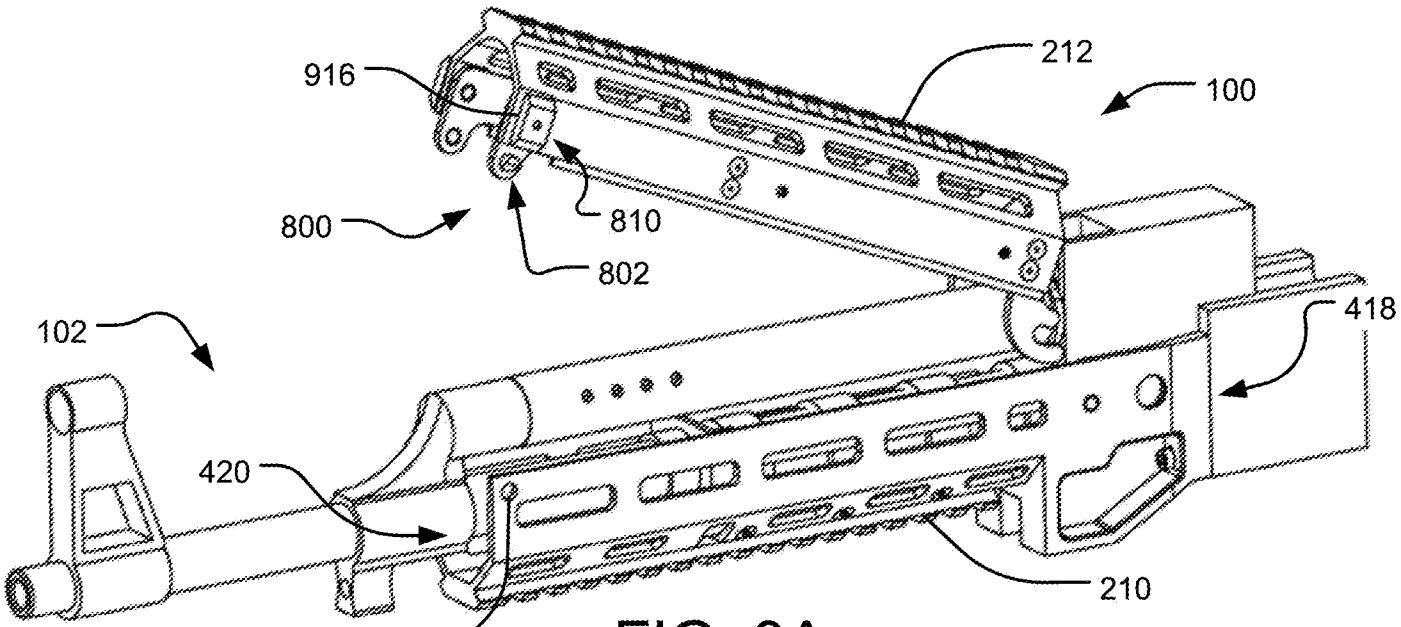
FIG. 8A is an isometric view of an upper handguard in position for assembly with the lower handguard and a mounting system according to at least one instance of the present disclosure.

FIG. 8A is an isometric view of the upper handguard 212 in position for assembly with the lower handguard 210 and the mounting system 200 according to at least one instance of the present disclosure. The upper handguard 212 is pivotally engaged with the proximal end 418 of the lower handguard 210 and coupled with the lower handguard 210 at the distal end 420 of the lower handguard 210 by one or more fasteners 800. Each of the one or more fasteners 800 is one of a displaceable protrusion 802 having a biasing element 808 disposed therein or an aperture 806. The distal end 420 of the lower handguard 210 includes the other of the displaceable protrusion 802 having the biasing element 808 therein or the aperture 806. The displaceable protrusion 802 is receivable into the aperture 806, thereby securing the distal end 420 of the lower handguard 210 to the upper handguard 212.

Figure 8B:
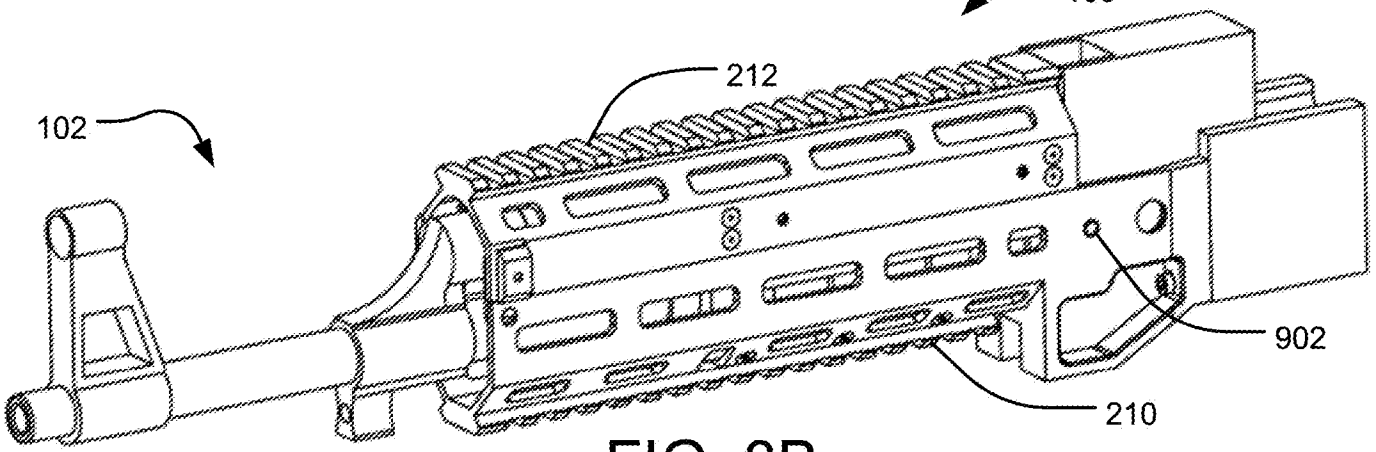
FIG. 8B is an isometric view of an upper handguard coupled with a lower handguard and a mounting system according to at least one instance of the present disclosure.

FIG. 8B is an isometric view of the upper handguard 212 coupled with the lower handguard 210 and the mounting system 200 according to the present disclosure. The ease of which the upper handguard 210 couples to the lower handguard 210 allows the upper handguard 210 to be simply removed by disengaging the one or more fasteners 800 and pivoting the upper handguard 210 out of the lower handguard 212. This allows easy access to the gas piston assembly 600 for assembly and/or maintenance without removing the lower handguard 210.

Figure 9:
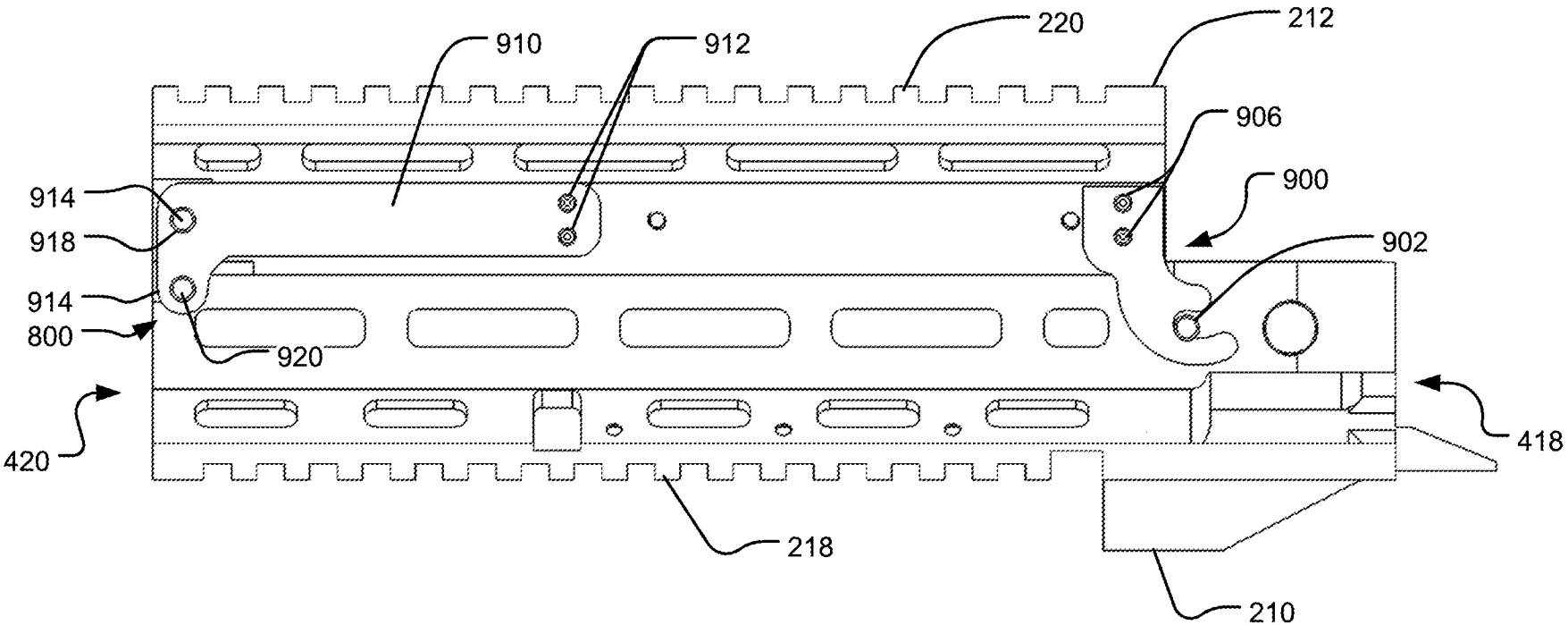
FIG. 9 is a side cross section of a handguard adapter assembly having an upper handguard coupled to a lower handguard according to at least one instance of the present disclosure.

FIG. 9 illustrates a side cross section of the upper handguard 212 coupled to the lower handguard 210, detailing the coupling between the upper handguard 212 and the lower handguard 210. In one example, the upper handguard 210 pivotally engages with the lower handguard 210 at the proximal end 418 via a hook 900 coupled to the upper handguard 212 and a pin 902 coupled to the lower handguard 210. The hook 900 pivots around the pin 902 and when locked in place, prevents the upper handguard 212 from upwardly disengaging from the lower handguard 210.

In the illustrated instance, the one or more fasteners 800 are a pair of elongated plates 910 fastened to a first and second side of the upper handguard 212 through a pair of apertures 912 at a first end of each the elongated plates 910. In the same example, the biasing element 808 of each elongated plate 910 is a pin 914 coupled to a spring member 916 through an aperture 918 of the elongated plate 910 on a second end and an aperture of the upper handguard 212. In the same example implementation, the displaceable protrusion 802 of each elongated plate 910 is a pin 920 coupled to an extension 922. The spring member 916 allows the each of the pins 920 to contract towards each other when each of the extensions 922 experiences a pinching force. When each of the pins 920 is contracted, the upper handguard 212 can be positioned such that each of the pins 920 is aligned with each corresponding aperture 806 of the lower handguard 210. Each of the pins 920 can be released and each spring member 916 pushes each pin 920 into the corresponding aperture 806 and bias each pin 920 so as to lock the upper handguard 212 to the lower handguard 210.

The handguard adapter assembly 100 described allows a high recoil accessory to be mounted to a variety of firearm 104 variants while also withstanding the recoil of the high force assembly, such as the grenade launcher 102. The assembly 100 also provides for easy access to the gas piston assembly 600 for cleaning and maintenance without the need to remove the lower handguard 210. The assembly 100 also provides for picatinny rail mounts 218, 220 to allow for accessories to be mounted to the assembly 100 in addition to the grenade launcher 102.

The description above includes example systems, methods, and/or techniques, products that embody techniques of the present disclosure. However, it is understood that the described disclosure may be practiced without these specific details.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes.

While the present disclosure has been described with reference to various embodiments, it will be understood that these embodiments are illustrative and that the scope of the disclosure is not limited to them. Many variations, modifications, additions, and improvements are possible. More generally, embodiments in accordance with the present disclosure have been described in the context of particular implementations. Functionality may be separated or combined in blocks differently in various embodiments of the disclosure or described with different terminology. These and other variations, modifications, additions, and improvements may fall within the scope of the disclosure as defined in the claims that follow.

What is claimed is:

1. A handguard adapter assembly operable to couple a recoil accessory to a firearm, the handguard adapter assembly comprising:

a mounting system operable to be coupled to the firearm, the mounting system comprising:

a lower clamp; and an upper clamp operably engaged with the lower clamp;

a lower handguard operably coupled to the lower clamp; and an upper handguard operably coupled to the lower handguard, wherein the mounting system is configured to be disposed around a substantially tubular member of the firearm, wherein the lower handguard includes a trunnion mounting assembly receivable by an opening formed in a trunnion, the trunnion mounting assembly includes an upper wedge and a lower wedge, the upper wedge and the lower wedge coupled by a fastener, the upper wedge translatable relative to the lower wedge by rotation of the fastener.

2. The handguard adapter assembly of claim 1, wherein the lower wedge includes a first wedge and a second wedge, the second wedge spaced apart from the first wedge.

3. The handguard adapter assembly of claim 1, wherein the upper wedge has a length spanning a distance from an outer surface of the first wedge to an outer surface of the second wedge.

4. The handguard adapter assembly of claim 1, wherein the lower handguard includes a picatinny rail.

5. The handguard adapter assembly of claim 1, wherein the upper handguard includes a picatinny rail.

6. The handguard adapter assembly of claim 1, wherein the upper clamp includes a housing that is disposable over and operable to receive the substantially tubular member.

7. The handguard adapter assembly of claim 1, wherein the lower clamp includes a concave surface on an upperside of a rail, the concave surface configured to receive the substantially tubular member.

8. The handguard adapter assembly of claim 7, wherein the lower clamp includes a plurality of extensions extending away from a longitudinal axis of the rail, and wherein each of the plurality of extensions has at least one upper clamp aperture.

9. The handguard adapter assembly of claim 8, wherein the upper clamp includes a plurality of clamp extensions, and wherein each of the plurality of clamp extensions has at least one lower clamp aperture aligned with the at least one upper clamp aperture of each of the plurality of extensions of the lower clamp, the upper clamp configured to be coupled with the lower clamp by a fastener secured between each of the at least one lower clamp aperture and each of the at least one upper clamp aperture.

10. A handguard adapter assembly comprising:

a lower handguard operable to couple to a mounting system having a proximal end and a distal end opposite the proximal end, the lower handguard having a trunnion mounting assembly on the proximal end, the trunnion mounting assembly receivable by an opening formed in a trunnion; and an upper handguard operable to be coupled to the lower handguard, the upper handguard positioned over a substantially tubular member, wherein the trunnion mounting assembly includes an upper wedge and a lower wedge, the upper wedge and the lower wedge coupled by a fastener, the upper wedge translatable relative to the lower wedge by rotation of the fastener.

11. The handguard adapter assembly of claim 10, wherein the lower wedge includes a first wedge positioned on a first side of the proximal end and a second wedge positioned on a second side of the proximal end, wherein the second side is opposite the first side.

12. A handguard adapter assembly comprising:

a lower handguard operable to couple to a mounting system having a proximal end and a distal end opposite the proximal end, the mounting system operable to be coupled to a firearm;

a trunnion mounting assembly extending from the proximal end of the lower handguard and operable to be received by an opening formed in a trunnion, the trunnion mounting assembly comprising:

a lower wedge; and an upper wedge, the upper wedge coupled to the lower wedge by a fastener, the upper wedge translatable relative to the lower wedge by rotation of the fastener.

13. The handguard adapter assembly of claim 12, wherein the lower wedge includes a first wedge and a second wedge spaced apart from the first wedge, and wherein the upper wedge includes a length spanning a distance between an outer surface of the first wedge and an outer surface of the second wedge.

* * * * *